US009907986B2

(12) United States Patent
Siewert et al.

(10) Patent No.: US 9,907,986 B2
(45) Date of Patent: Mar. 6, 2018

(54) FIRE SUPPRESSION SYSTEM WITH DUAL USE OF GAS SOURCE

(75) Inventors: Bryan Robert Siewert, Clinton, CT (US); Ulf J. Jonsson, South Windsor, CT (US); Mike Lindsay, Swainsboro, GA (US)

(73) Assignee: UTC Fire & Security Corporation, Farmington, CT (US)

( * ) Notice: Subject to any disclaimer, the term of this patent is extended or adjusted under 35 U.S.C. 154(b) by 775 days.

(21) Appl. No.: 13/976,472

(22) PCT Filed: Dec. 30, 2010

(86) PCT No.: PCT/US2010/062452

§ 371 (c)(1), (2), (4) Date: Jun. 27, 2013

(87) PCT Pub. No.: WO2012/091711

PCT Pub. Date: Jul. 5, 2012

(65) Prior Publication Data

US 2013/0292143 A1 Nov. 7, 2013

(51) Int. Cl.

| | |
|---|---|
| ***A62C 5/00*** | (2006.01) |
| ***A62C 35/02*** | (2006.01) |
| ***A62C 35/64*** | (2006.01) |
| ***A62C 35/68*** | (2006.01) |
| ***A62C 99/00*** | (2010.01) |
| ***A62C 5/02*** | (2006.01) |

(52) U.S. Cl.

CPC ..... *A62C 35/026* (2013.01); *A62C 5/002* (2013.01); *A62C 5/008* (2013.01); *A62C 5/022* (2013.01); *A62C 35/64* (2013.01); *A62C 35/645* (2013.01); *A62C 35/68* (2013.01); *A62C 99/0072* (2013.01)

(58) Field of Classification Search

CPC ..... A62C 5/008; A62C 35/023; A62C 35/026; A62C 35/645; B05B 7/2416

USPC ..... 169/9, 13, 14, 15, 44, 46; 239/303, 311, 239/369

See application file for complete search history.

(56) References Cited

U.S. PATENT DOCUMENTS

| | | | | |
|---|---|---|---|---|
| 3,337,195 | A | 8/1967 | Farison | |
| 3,342,271 | A * | 9/1967 | Charles, Jr. | 169/15 |
| 4,345,654 | A | 8/1982 | Carr | |

(Continued)

FOREIGN PATENT DOCUMENTS

| | | |
|---|---|---|
| WO | 9423798 | 10/1994 |

OTHER PUBLICATIONS

International Search Report and Written Opinion of the International Searching Authority for International application No. PCT/US2010/062452 dated Sep. 28, 2011.

(Continued)

*Primary Examiner* — Ryan A Reis

(74) *Attorney, Agent, or Firm* — Carlson, Gaskey & Olds

(57) ABSTRACT

An exemplary fire suppression system includes a sprinkler nozzle. At least one conduit is connected to the nozzle for delivering a fire suppression fluid to the nozzle. The conduit and the nozzle establish a discharge path. A pneumatically driven pump is connected with the conduit for pumping fluid into the conduit. A gas source provides pressurized gas to the pump for driving the pump. The gas source also provides gas to the discharge path for achieving a desired discharge of the fluid from the nozzle.

9 Claims, 1 Drawing Sheet

(56) References Cited

U.S. PATENT DOCUMENTS

| | | | | |
|---|---|---|---|---|
| 5,255,747 | A | 10/1993 | Teske et al. | |
| 5,411,100 | A | 5/1995 | Laskaris et al. | |
| 5,713,417 | A * | 2/1998 | Sundholm | 169/46 |
| 5,738,174 | A * | 4/1998 | Sundholm | 169/46 |
| 5,799,735 | A | 9/1998 | Sundholm | |
| 5,957,210 | A | 9/1999 | Cohrt et al. | |
| 6,009,953 | A | 1/2000 | Laskaris et al. | |
| 6,155,351 | A * | 12/2000 | Breedlove et al. | 169/14 |
| 6,173,791 | B1 | 1/2001 | Yen | |
| 6,267,183 | B1 * | 7/2001 | Smagac | 169/30 |
| 6,390,203 | B1 | 5/2002 | Borisov et al. | |
| 6,991,041 | B2 | 1/2006 | Laskaris et al. | |
| 7,712,542 | B2 | 5/2010 | Munroe | |
| 2005/0173131 | A1 * | 8/2005 | Dunster et al. | 169/44 |
| 2010/0175897 | A1 * | 7/2010 | Crump | 169/14 |
| 2010/0294518 | A1 | 11/2010 | Lelic et al. | |

OTHER PUBLICATIONS

International Preliminary Report on Patentability for International application No. PCT/US2010/062452 dated Jul. 11, 2013.
Supplementary European Search Report for Application No. EP 10 86 1456 dated Oct. 7, 2016.

* cited by examiner

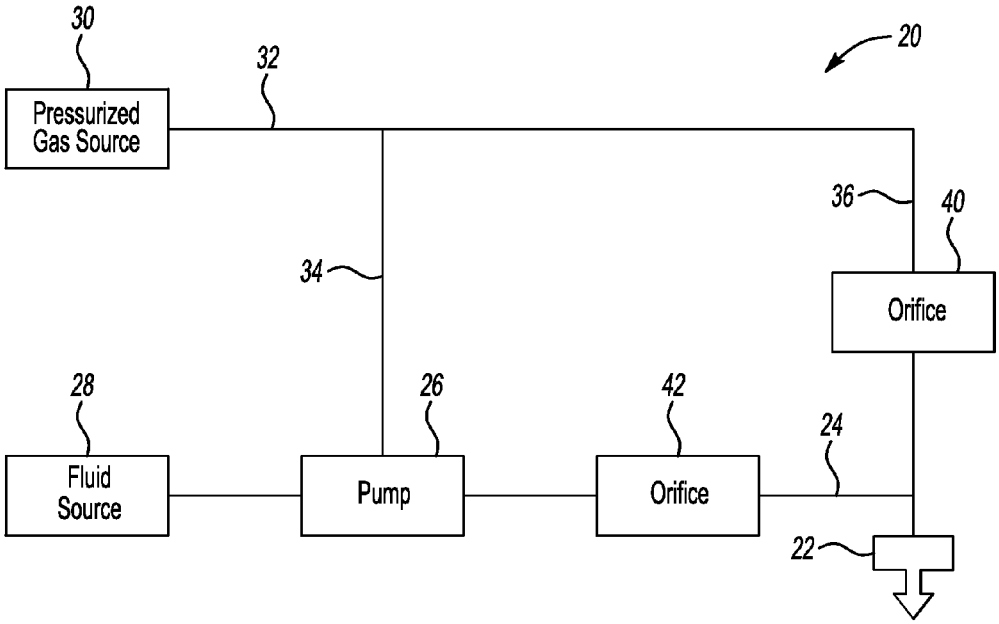
30
Pressurized Gas Source
32
20
36
40
34
Orifice
28
26
42
24
Fluid Source
Pump
Orifice
22

FIRE SUPPRESSION SYSTEM WITH DUAL USE OF GAS SOURCE

BACKGROUND

There are a variety of fire suppression systems. Many utilize sprinkler heads or nozzles mounted near a ceiling in various positions in a room. Some such systems are known as deluge systems. These release a relatively large amount of water responsive to a fire condition to douse a fire and saturate objects in the room to prevent them from igniting.

Other sprinkler-based fire suppression systems release a fine mist into a room responsive to a fire condition. One advantage to such systems over deluge systems is that they use less water. On the other hand, some misting systems require relatively high pressure to achieve the desired discharge of fire suppressing fluid. Typical misting systems use pressurized gas to shear the fluid as it is dispersed from the nozzles.

Most mist-based fire suppression systems include a pump to achieve the pressures necessary for system operation. Water-based systems, for example, require an operating pressure that is higher than the typical pressure available from a municipal water supply. The pump is often one of the most expensive components of the system, which hinders an ability to reduce the cost of the system. Some systems also include pressurized gas tanks that pressurize the fluid lines that deliver the fluid to the sprinkler nozzles.

SUMMARY

An exemplary fire suppression system includes a sprinkler nozzle. At least one conduit is connected to the nozzle for delivering a fire suppression fluid to the nozzle. The conduit and the nozzle establish a discharge path. A pneumatically driven pump is connected with the conduit for pumping fluid into the conduit. A gas source provides pressurized gas to the pump for driving the pump. The gas source also provides gas to the discharge path for achieving a desired discharge of the fluid from the nozzle.

An exemplary method of operating a fire suppression system having a pneumatically driven pump connected to a conduit that is connected to a nozzle includes driving the pump with pressurized gas from a gas source to cause the pump to deliver a pressurized fluid through the conduit to the nozzle. A desired discharge of the fluid from the nozzle is achieved by providing gas from the gas source to the discharge path established by the nozzle and the conduit.

The various features and advantages of a disclosed example will become apparent to those skilled in the art from the following detailed description. The drawing that accompanies the detailed description can be briefly described as follows.

BRIEF DESCRIPTION OF THE DRAWING

FIG. 1 schematically illustrates selected portions of a fire suppression system designed according to an embodiment of this invention.

DETAILED DESCRIPTION

FIG. 1 schematically shows selected portions of a fire suppression system 20. An example sprinkler nozzle 22 is positioned to discharge a fire suppressing fluid into an area responsive to a fire condition. The nozzle 22 is connected to a conduit 24. The nozzle 22 and the conduit 24 establish a discharge path. A pump 26 causes fluid from a source 28 to flow through the conduit to the nozzle 22. In one example the fluid comprises water and the source 28 is a municipal water supply. In another example, the fluid source 28 is a reservoir of a selected fluid such as water. In one example the fluid reservoir is at ambient pressure.

The pump 26 in this example is a pneumatically driven hydraulic pump. The pump 26 delivers the fluid (e.g., water) to the nozzle 22 through the conduit 24 when the pump 26 is driven by pressurized gas. The illustrated example includes a pressurized gas source 30 that provides pressurized gas through a supply line 32. In one example the gas source 30 comprises a rotary compressor. In another example, the gas source 30 comprises at least one pressurized tank. The gas may be air, nitrogen or carbon dioxide for example.

One branch 34 of the supply line 32 delivers pressurized gas to the pump 26 to drive the pump 26 for delivering the fluid from the supply 28 to the nozzle 22. Another branch 36 of the supply line 32 delivers the gas to the discharge path (i.e., at least one of the nozzle 22 or the conduit 24) at some point (e.g., upstream of the nozzle 22 or at the nozzle 22) to achieve a desired discharge of the fire suppressing fluid from the nozzle 22. The particular location at which the gas is introduced for achieving the desired discharge will depend on the particular design of the system 20, the nozzle 22 or both. For example, a system that relies upon mixing gas and liquid upstream of the nozzle 22 will include a branch 36 that provides the pressurized gas into the conduit 24 at a suitable location. Another system that relies upon mixing gas and liquid within the nozzle 22 will include the branch 36 coupled to a suitable inlet of the nozzle 22.

One example uses an effervescent discharge from the nozzle 22. In such an example, the gas is provided to the nozzle 22 or within the conduit 24 in a manner that results in a fluid mixture of liquid and gas bubbles. The bubbly mixture results in an effervescent discharge from the nozzle 22 as the gas bubbles burst upon exiting the nozzle 22, which causes the fluid to break up into droplets establishing a mist discharge from the nozzle 22.

Given this description and a chosen system or nozzle configuration, those skilled in the art will be able to determine the best location for introducing the gas for achieving the desired discharge.

One feature of the illustrated example is that the same gas source 30 provides pressurized gas for driving the pump 26 and pressurized gas to achieve the desired discharge from the nozzle 22.

This example eliminates a separate electrical connection for the pump 26. For systems 20 that include pressurized cylinders as the gas source 30, no electrical connection is required for the entire system. Another feature of the illustrated example is that it reduces the footprint (or occupied space) of the pump compared to other systems that do not include such a pump. It also utilizes the gas source 30 for the dual purpose of supplying gas to the system 20 to achieve a desired discharge from the nozzle 22 and to drive the pump 26. This provides a lower cost arrangement for a supply of liquid and gas (e.g., water and air) that provides the desired pressure of each for the system 20.

The pump 26 in one example is a unity gain pump. Such a pump provides a liquid pressure within the conduit 24 that is essentially equal to the pressure of the gas that drives the pump 26. In one such example, the gas source 30 delivers the gas at a pressure that is the target pressure of the gas used to achieve the desired discharge from the nozzle. One example gas source 30 for such a system is a compressor that provides a gas pressure on the order of 250 psig.

In another example, the pump 26 is a low gain pump. The pressurized gas has a higher pressure than is required for system operation. The pump 26 has gain that results in the desired liquid pressure at the nozzle 22. The gas pressure delivered through the branch 36 in the illustrated example is controlled by an orifice 40 to achieve a desired pressure. The illustrated example also includes a pressure-controlling orifice 42 associated with the conduit 24 to provide a desired liquid pressure at the nozzle. The orifices 40 and 42 allow for fine-tuning the delivered pressures to compensate for any difference in the pressure provided by the gas source 30 or the resulting pressure provided by the pump 26 and the corresponding pressure needed at the nozzle 22.

The preceding description is exemplary rather than limiting in nature. Variations and modifications to the disclosed examples may become apparent to those skilled in the art that do not necessarily depart from the essence of this invention. The scope of legal protection given to this invention can only be determined by studying the following claims.

We claim:

1. A method of operating a fire suppression system having a pneumatically driven pump connected to a conduit that is connected to a nozzle, the conduit and the nozzle establishing a discharge path, the method comprising the steps of:

driving the pump with pressurized gas from a gas source to cause the pump to deliver a pressurized fluid to the nozzle;

providing gas from the gas source to the discharge path to achieve a fluid mixture of liquid and gas bubbles in the discharge path; and achieving an effervescent mist discharge of the fluid from the nozzle as gas bubbles from the mixture of liquid and gas bubbles burst upon exiting the nozzle, thereby causing the fluid to break up into liquid droplets establishing the effervescent mist discharge from the nozzle.

2. The method of claim 1, wherein the discharge is an effervescent water mist discharge.

3. The method of claim 1, comprising providing the gas to the nozzle and introducing the gas into the fluid.

4. The method of claim 1, wherein the fluid comprises water and the method comprises obtaining water from a municipal water supply at a pressure provided by the municipal water supply; and increasing a pressure of the water delivered to the nozzle above the pressure provided by the municipal water supply using the pump.

5. The method of claim 1, wherein the fluid comprises water and the method comprises providing a reservoir of water at ambient pressure; and increasing a pressure of the water delivered to the nozzle above the ambient pressure using the pump.

6. The method of claim 1, comprising providing the fluid to the pump at a first pressure;

increasing the pressure of the fluid delivered by the pump to the nozzle to a second, higher pressure; and selecting at least one of a gain of the pump or a pressure of the gas provided to the pump to thereby control a difference between the first and second pressures.

7. The method of claim 1, comprising providing the gas from the gas source to the conduit upstream of the nozzle.

8. The method of claim 1, comprising providing the gas from the gas source into the nozzle.

9. The method of claim 1, wherein the gas source is one of a compressor or a pressurized container.

* * * * *